US007788757B2

(12) United States Patent
Lei

(10) Patent No.: US 7,788,757 B2
(45) Date of Patent: Sep. 7, 2010

(54) FUN SHOWER BRUSH

(76) Inventor: Chia-Ho Lei, No. 20, Lane 44, Datong W. Rd., Taoyuan (TW) 330

( * ) Notice: Subject to any disclaimer, the term of this patent is extended or adjusted under 35 U.S.C. 154(b) by 533 days.

(21) Appl. No.: 11/892,336

(22) Filed: Aug. 22, 2007

(65) Prior Publication Data

US 2008/0295268 A1 Dec. 4, 2008

Related U.S. Application Data

(63) Continuation-in-part of application No. 11/807,778, filed on May 31, 2007, now abandoned.

(51) Int. Cl.
*A46B 13/02* (2006.01)
*A46B 13/04* (2006.01)
*A63H 33/28* (2006.01)

(52) U.S. Cl. ..... 15/28; 15/4; 15/29; 15/97.1; 15/105; 401/195; 446/15; 601/114

(58) Field of Classification Search ..... 15/4, 15/23, 24, 28, 29, 97.1, 105; 401/6, 195, 401/270; 446/15; 601/114
See application file for complete search history.

(56) References Cited

U.S. PATENT DOCUMENTS 3,210,790 A * 10/1965 Neumann ..... 15/118
4,724,563 A * 2/1988 Fry et al. ..... 15/28
5,498,191 A * 3/1996 DeMars ..... 446/15
5,909,754 A * 6/1999 Oh ..... 15/29

* cited by examiner

*Primary Examiner*—Mark Spisich
(74) *Attorney, Agent, or Firm*—Bacon & Thomas, PLLC

(57) ABSTRACT

The invention is a fun shower brush. The brush has a bubble-making device on its top part. Different kinds of brush can be fitted into the front of the shower brush to meet the needs of the user. This design makes the brush suitable for use by the general public and the bubble-making device makes showering more fun.

2 Claims, 4 Drawing Sheets

FUN SHOWER BRUSH

This is a CIP application of Ser. No. 11/807,778, Filed: May 31, 2007, Entitled: "Fun shower brush", now abandoned.

BACKGROUND OF THE INVENTION

1. Field of the Invention

This is a fun shower brush with a bubble-making device on it, the use of which can make showering more fun.

2. Description of the Prior Art

Most shower brushes on the market only have a single body scrubbing function, making their use monotonous and boring.

SUMMARY OF THE INVENTION

The objective of this invention is to offer a fun shower brush.

This objective of this invention is to provide a fun shower brush, with a bubble-making device on it, which can make showering more fun.

BRIEF DESCRIPTION OF DRAWINGS

This invention is better understood by referring to the accompanying drawings, wherein.

DETAILED DESCRIPTION OF THE PREFERRED EMBODIMENT

Figure 1:
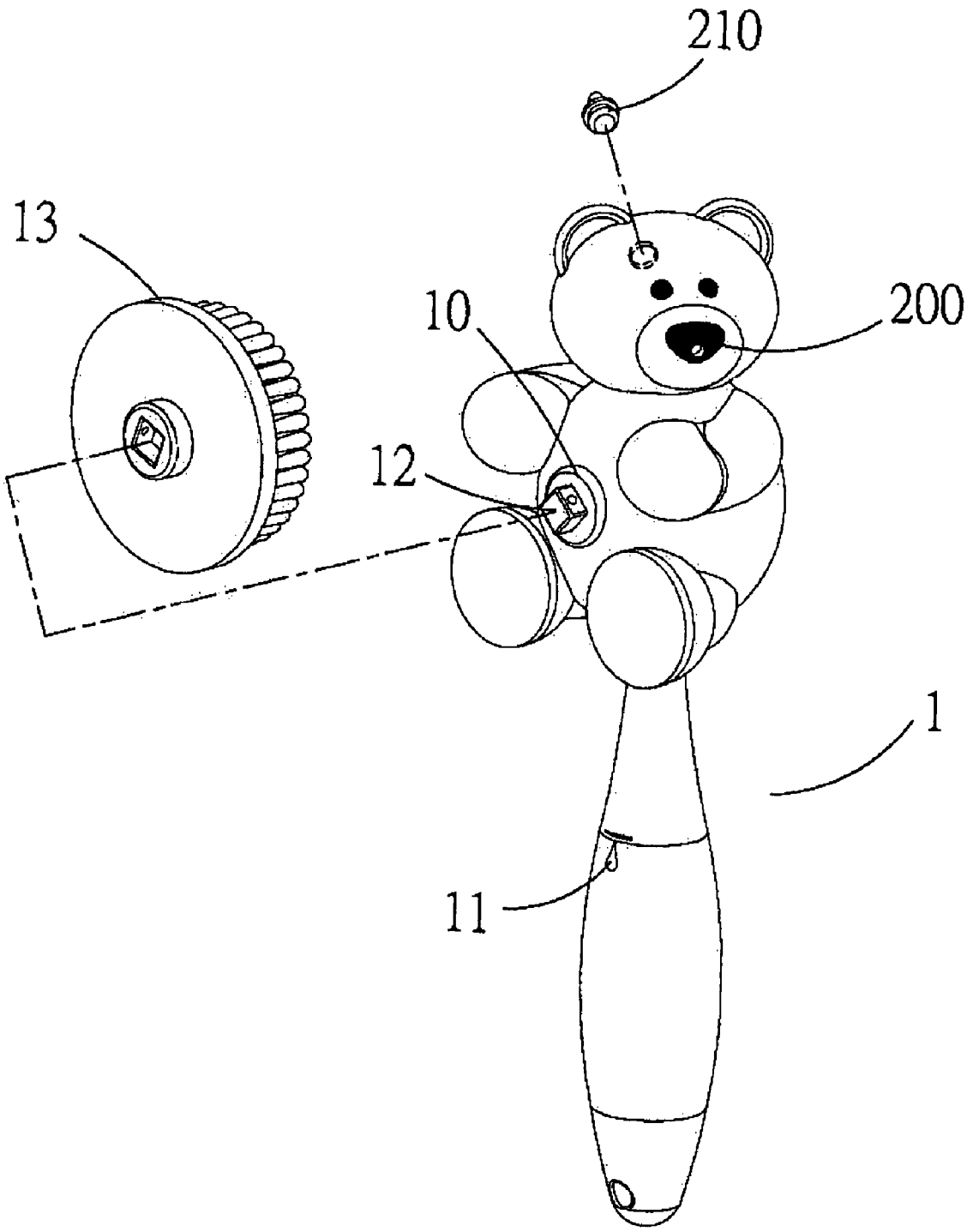
FIG. 1 is an exploded perspective view of this fun shower brush, including electric brush and bubble-making device.
Figure 2:
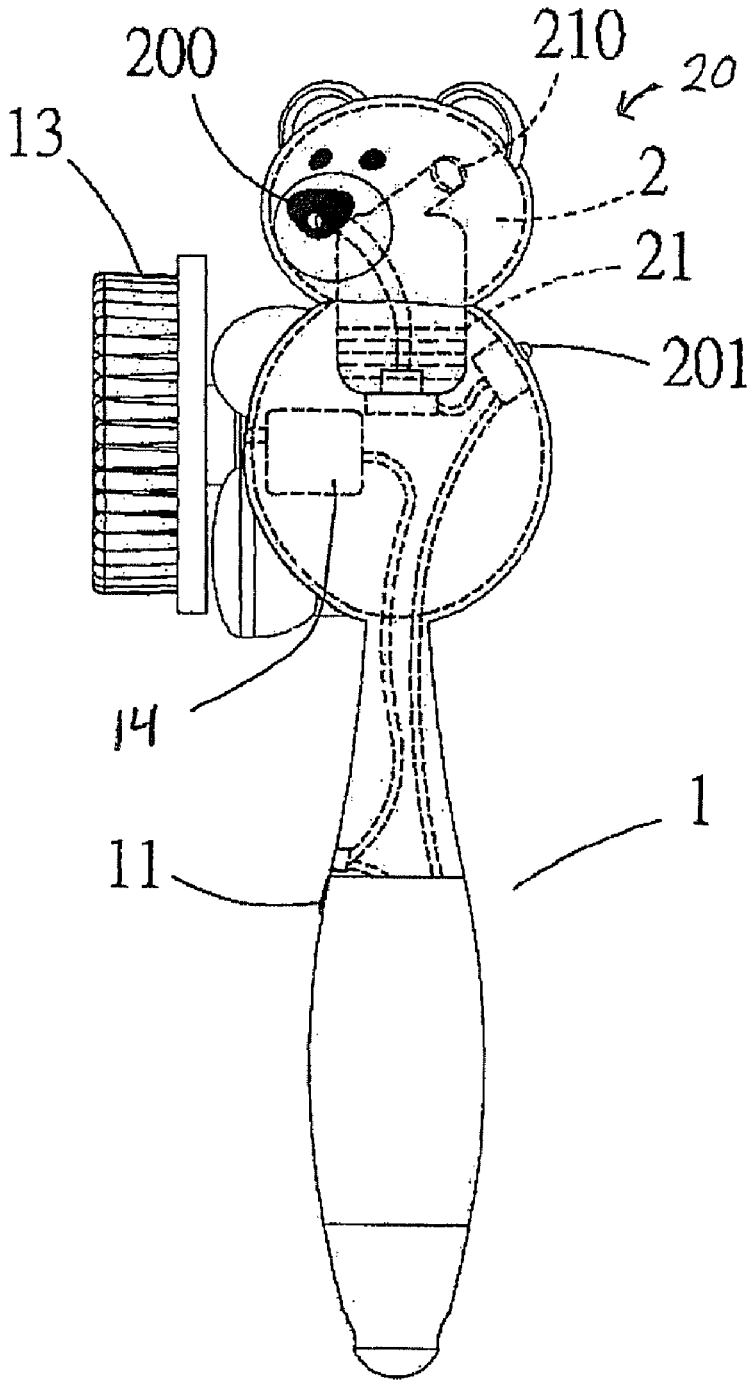
FIG. 2 is an abridged general view of the join of the brush and brush holder of this fun shower brush.
Figure 3:
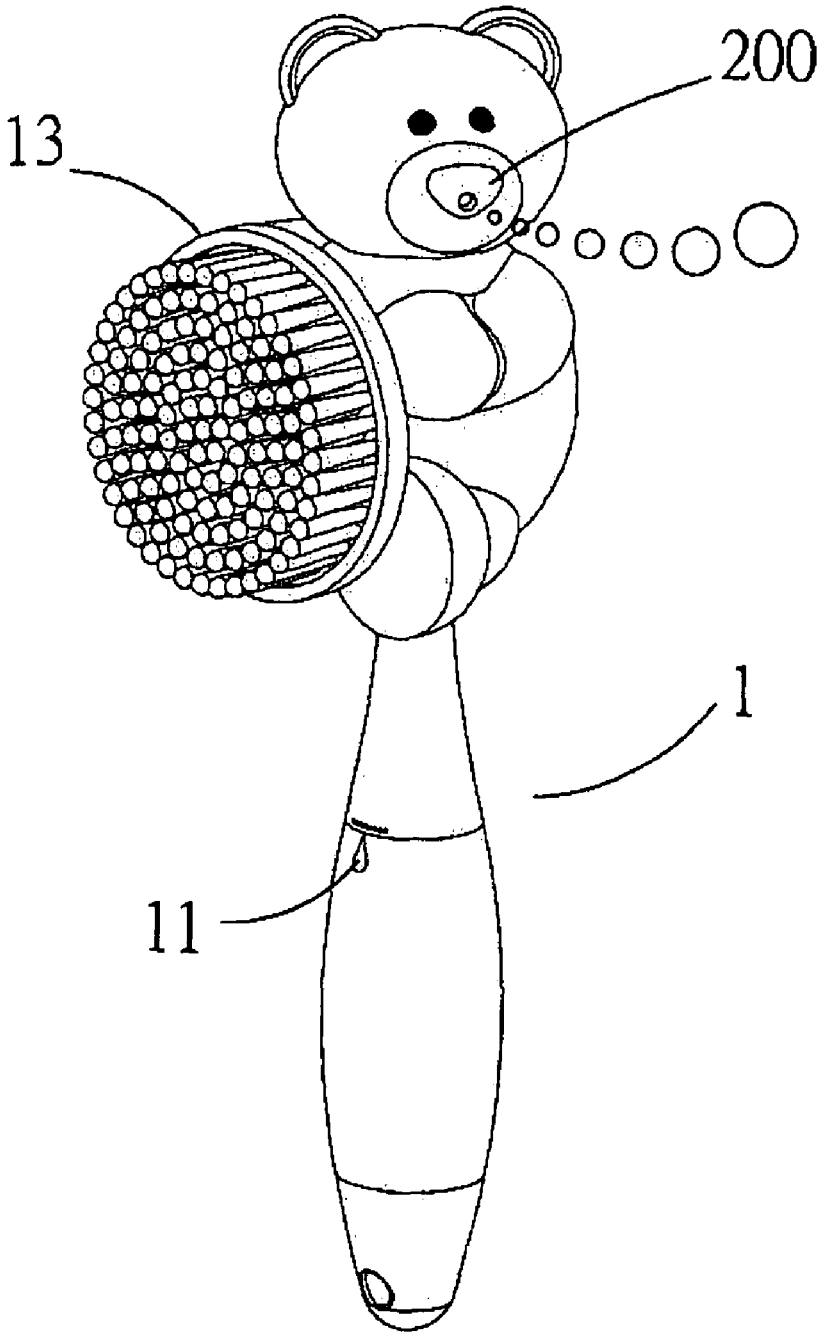
FIG. 3 is an abridged general view of the fun shower brush when the bubble-making device is activated and bubbles are produced.
Figure 4:
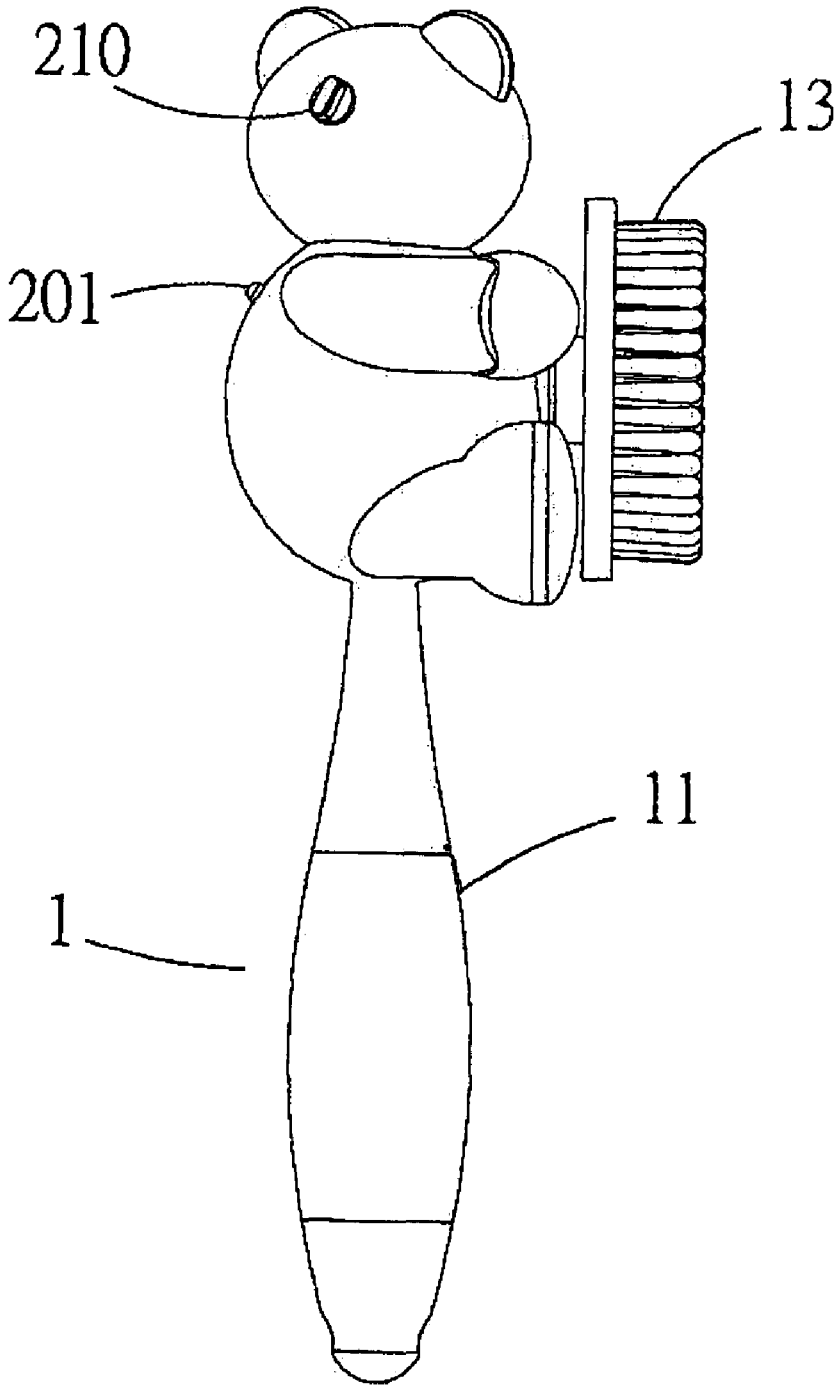
FIG. 4 is a perspective view of the fun shower brush from another angle.

As shown in FIGS. 1~4, a preferred embodiment of the fun shower brush in the present invention includes an electric shower brush 1 and an electric bubble-making device 2.

The electric shower brush 1 has a brush clip-in brush holder 10. The handle of electric shower brush 1 has a knob switch 11 which is activated to make the clip-in brush holder 10 of the electric brush turn via motor 14. Knob switch 11 can be used to adjust the speed of turn of the clip-in brush holder 10 and provide a massage function. Clip-in brush holder 10 has a clip 12 which allows the position of brush 13 to be changed. Brush 13 is composed of various different brushes (including hair-brush, sponge.).

Electric bubble-making device 2 is fitted on the top part of the electric shower brush 1. Electric bubble-making device 2 is made up of bubble blowing device 20, bubble soapy water 21. Bubble blowing device 20 has a bubble blow hole 200 and power switch 201, the bubble blow hole 200 is positioned at an angle that does not directly face the user. When power switch 201 of the electric bubble making device 2 is activated, bubble blow hole 200 on bubble blowing device 20 will continually produce bubbles. The soapy water used to make bubbles 21 can be replenished by opening knob 210 on the bubble blowing device 20 (soap water for example).

When showering, all that is needed is that the user selects the brush 13 and clicks it into the brush holder 10 of the electric shower brush 1, then applies soap to brush 13 and turns on the knob switch 11 on the handle and the power switch 201 on electric bubble-making device 2. This will allow the user to have a shower that is more fun because they are accompanied by bubbles.

This electric powered shower brush 1 can also be used as an ordinary brush, for example, as a cleaning brush, car washing brush etc, also at the same time, providing a fun bubble effect.

The invention has the following advantages as can be seen from the foresaid description.

1. It is a fun shower brush with a knob switch 11 on it to allow the user to control the turn speed of brush 13, making it suitable for users of all ages.

2. It has an electric bubble making device 2 which can make children more willing to shower because showering is more fun for them.

3. The brush 13 can be changed to meet the needs of different users or to allow an individual's own brush 13 to be removed and cleaned, for better hygiene.

4. The brush 13 of this fun shower brush can also be replaced by a car washing brush or cleaning brush, making various types of cleaning and brushing work more fun and more interesting.

While the preferred embodiment of the invention has been described above, it will be recognized and understood that various modifications may be made therein and the appended claims are intended to cover all such modifications that may fall within the spirit and scope of the invention.

What is claimed is:

1. An electric cleaning brush, comprising:

a handle adapted to be gripped by a user;

a brush;

a motor coupled to the handle for rotating the brush;

a clip-in brush holder coupled to the motor and receiving the brush, the clip-in brush holder allowing the position of the brush to be adjusted and being adapted to receive various other brushes;

a knob switch disposed on the handle for adjusting the speed of the motor; and an electric bubble-making device coupled to an upper portion of the handle and disposed in an inner portion of the cleaning brush, the bubble-making device including:

a bubble blow hole for ejecting bubbles from the bubble-making device;

a soapy water compartment for housing soapy water; and a power switch for controlling the ON/OFF status of the bubble-making device.

2. The electric cleaning brush according to claim 1, wherein the brush is one of a car washing brush and a body washing brush.

* * * * *